US008505507B2

(12) United States Patent
Nakamura et al.

(10) Patent No.: US 8,505,507 B2
(45) Date of Patent: Aug. 13, 2013

(54) FLOW RATE CONTROL VALVE

(75) Inventors: Kiyoharu Nakamura, Seto (JP); Jyunji Yokota, Chiryu (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 229 days.

(21) Appl. No.: 13/150,823

(22) Filed: Jun. 1, 2011

(65) Prior Publication Data

US 2011/0303169 A1 Dec. 15, 2011

(30) Foreign Application Priority Data

Jun. 9, 2010 (JP) ..... 2010-132084

(51) Int. Cl.
*F01L 1/34* (2006.01)

(52) U.S. Cl.
USPC ..... 123/90.17; 123/90.15; 137/625.68; 464/160

(58) Field of Classification Search
USPC ..... 123/90.15, 90.17; 137/625.68; 464/160
See application file for complete search history.

(56) References Cited

U.S. PATENT DOCUMENTS 7,444,968 B2 * 11/2008 Lancefield et al. ..... 123/90.17

FOREIGN PATENT DOCUMENTS

| | | |
|---|---|---|
| JP | U-60-167275 | 11/1985 |
| JP | U-02-24012 | 2/1990 |
| JP | U-05-069473 | 9/1993 |
| JP | A-2004-301010 | 10/2004 |
| JP | A-2005-69227 | 3/2005 |
| JP | A-2005-249562 | 9/2005 |
| JP | A-2005-530077 | 10/2005 |
| JP | A-2005-530078 | 10/2005 |
| JP | A-2006-17085 | 1/2006 |
| JP | A-2006-152919 | 6/2006 |
| JP | A-2009-515090 | 4/2009 |
| JP | A-2009-127655 | 6/2009 |
| JP | A-2009-523943 | 6/2009 |
| WO | WO 03/078803 A1 | 9/2003 |
| WO | WO 03/078804 | 9/2003 |
| WO | WO 2007/051704 A1 | 5/2007 |
| WO | WO 2007/082600 A1 | 7/2007 |

OTHER PUBLICATIONS

May 8, 2012 Notification of Reason(s) for Refusal issued in Japanese Patent Application No. JP-A-2010-132084 (with translation).

* cited by examiner

*Primary Examiner* — Ching Chang
(74) *Attorney, Agent, or Firm* — Oliff & Berridge, PLC

(57) ABSTRACT

A flow rate control valve includes a housing having an accommodation chamber in communication with oil passages, and a spool accommodated in the accommodation chamber movably in a reciprocating manner. The housing includes a bolt for fastening a movable member of a variable valve timing mechanism, and a sleeve inserted in an insertion portion provided in the bolt and having the accommodation chamber. The bolt is provided with a port through which the oil passages communicate with the insertion portion. The sleeve is provided with a through hole penetrating the sleeve. Furthermore, an annular protrusion and a recess are provided as a phase adjustment portion that adjusts a phase of rotation of the sleeve with respect to the bolt to a phase in which the port coincides in position with the through hole and holds the phase of rotation of the sleeve with respect to the bolt equal thereto.

6 Claims, 11 Drawing Sheets

FLOW RATE CONTROL VALVE

INCORPORATION BY REFERENCE

The disclosure of Japanese Patent Application No. 2010432084 filed on Jun. 9, 2010 including the specification, drawings and abstract is incorporated herein by reference in its entirety.

BACKGROUND OF THE INVENTION

1. Field of the Invention

The invention relates to a flow rate control valve provided in an internal combustion engine equipped with a variable mechanism, which operates a movable member in accordance with the supply/discharge of a hydraulic fluid and thus makes a valve opening/closing characteristic of an engine valve variable, to control the valve opening/closing characteristic.

2. Description of Related Art

Generally, many internal combustion engines are equipped with a variable valve timing mechanism that varies the timing of the engine valves such as intake valves and exhaust valves to improve fuel economy, enhance output, and the like. In such internal combustion engines, a movable member of the variable valve timing mechanism, which is fastened to one end of a camshaft by a bolt, is operated through the supply and discharge (supply/discharge) of a hydraulic fluid to and from the variable valve timing mechanism to change the rotational phase of the camshaft relative to a crankshaft, thereby varying the valve timing of the engine valves.

The aforementioned supply/discharge of the hydraulic fluid is controlled through the driving of a flow rate control valve (an oil control valve) that includes a housing and a spool. The housing is disposed across a plurality of oil passages through which the hydraulic fluid is supplied/discharged to/from the variable valve timing mechanism. The housing includes an accommodation chamber, and a plurality of ports, through which the accommodation chamber communicates with the oil passages respectively, at a plurality of locations in a direction along an axis. A spool provided in the accommodation chamber may reciprocate in the axial direction of the accommodation chamber. The respective ports are then opened or closed based on the position of the spool in the axial direction of the accommodation chamber, the amounts of the hydraulic fluid supplied to and discharged from the variable valve timing mechanism are thereby adjusted, and the movable member is moved.

Meanwhile, in the variable valve timing mechanism, it is desirable to enhance the responsiveness in operating the variable mechanism and suppress the leakage of oil from the oil passages between the variable mechanism and the flow rate control valve. Accordingly, the flow rate control valve is ideally disposed in a central region of the variable valve timing mechanism, which shortens the oil passages therebetween.

As described in Published Japanese Translation of PCT Application No. 2009-515090 (JP-A-2009-515090), it is conceivable to employ as the aforementioned housing a bolt (a valve housing) for fastening a movable member (an output element) of a variable valve timing mechanism (a device for variably adjusting the control time of a gas exchange valve) to a camshaft, and endow this bolt with the function of a flow rate control valve (a control valve). It should be noted that the terms in parentheses following the names of the members are used in Published Japanese Translation of PCT Application No. 2009-515090 (JP-A-2009-515090).

In this case, a spool (a control piston) is accommodated in the bolt movably in a reciprocating manner in a direction along an axis. Various ports (an input port, a work port, and an output port) for supplying/discharging the hydraulic fluid to/from the variable valve timing mechanism are formed through the bolt. The spool is moved in the axial direction of the housing, so that the respective ports are opened or closed or the areas of communication (opening degrees) of the respective ports are changed. As a result, the amounts of the hydraulic fluid supplied to and discharged from the variable valve timing mechanism are adjusted.

Because the bolt is located in the central region of the variable valve timing mechanism, the flow rate control valve is near the variable valve timing mechanism. The oil passages for the hydraulic fluid between the flow rate control valve and the variable valve timing mechanism are short, and the areas of faces to be sealed are small. Consequently, responsiveness is enhanced and leakage of oil is suppressed.

However, if the bolt is screwed to the camshaft to fix the movable member to the camshaft, the bolt may become distorted by a fastening torque as a result of a manufacturing error of the movable member, an assembly error of the movable member, manufacturing errors of the bolt and the camshaft, or the like. Distortions of the bolt may result in a great dispersion of the gap between the bolt and the spool in some locations, thereby altering the flow rate characteristic of the flow rate control valve or cause an operational failure in the spool.

In this view, in the aforementioned Published Japanese Translation of PCT Application No. 2009-515090 (JP-A-2009-515090), an inner peripheral region of the bolt is constituted by a sleeve (a press medium guide insert) as a separate member. Each of the bolt and the sleeve is provided, at a plurality of locations along the axis, with a plurality of ports through which the accommodation chamber communicates with the oil passages respectively. The bolt and the sleeve together constitute the housing of the flow rate control valve.

According to the aforementioned Published Japanese Translation of PCT Application No. 2009-515090 (JP-A-2009-515090), the sleeve is interposed between the bolt and the spool. Thus, while the bolt is in charge of the fastening function of the housing of the flow rate control valve, the sleeve and the spool are in charge of the valve function of the housing of the flow rate control valve. The separate members are in charge of both the functions respectively. Therefore, the sleeve and the spool are not affected by the fastening torque of the bolt, and unlikely to be distorted.

However, in the above-described flow rate control valve with the sleeve constituting part of the bolt (the inner peripheral region thereof), the sleeve may be assembled with the bolt with the corresponding ports of the sleeve and the bolt deviant from each other in a circumferential direction respectively. In addition, the sleeve assembled with the bolt may rotate with respect to the bolt due to vibrations or the like of the internal combustion engine, and the ports of the sleeve may deviate from the ports of the bolt in the circumferential direction respectively. Then, if the respective ports are closed due to this distortion, it is difficult to ensure a flow rate required for the supply/discharge of the hydraulic fluid.

SUMMARY OF THE INVENTION

The invention provides a flow rate control valve that ensures a flow rate required for the supply/discharge of a hydraulic fluid.

A flow rate control valve according to an aspect of the invention is applied to an internal combustion engine equipped with a variable mechanism that operates a movable member in accordance with supply/discharge of a hydraulic fluid to make a valve opening/closing characteristic of an engine valve variable, is disposed across a plurality of oil passages through which the hydraulic fluid is supplied/discharged to/from the variable mechanism, is equipped with a housing having an accommodation chamber in communication with the respective oil passages, and a spool accommodated in the accommodation chamber movably in a reciprocating manner in a direction along an axis of the accommodation chamber, and changes a supply/discharge mode of the hydraulic fluid in accordance with a position of the spool in the direction along the axis to control the valve opening/closing characteristic. The housing is equipped with a bolt for fastening the movable member, and a sleeve inserted in an insertion portion provided in the bolt and having the accommodation chamber. The bolt is provided with a port through which the oil passages communicate with the insertion portion. The sleeve is provided with a through hole penetrating the sleeve. Furthermore, the housing is provided with a phase adjustment portion that adjusts a phase of rotation of the sleeve with respect to the bolt to a phase in which the port coincides in position with the through hole and holds the phase of rotation of the sleeve with respect to the bolt equal thereto.

According to the aspect of the invention, when the sleeve is assembled into the bolt, the phase of rotation of the sleeve with respect to the bolt is adjusted by the phase adjustment portion. When the phase of the sleeve is thus adjusted, the port coincides in position with the through hole and is unlikely to be blocked by that region of the sleeve which is not provided with the through hole. Accordingly, the oil passages for supplying/discharging the hydraulic fluid communicate with the accommodation chamber in the sleeve through the port and the through hole, so that a flow rate required for the supply/discharge of the hydraulic fluid is ensured.

Further, the aforementioned sleeve is held in that phase after being adjusted in phase as well. Accordingly, even if a force acting to rotate the sleeve is applied thereto due to vibrations or the like from the internal combustion engine, the port continues to coincide in position with the through hole because the aforementioned phase is maintained. As a result, the foregoing effect of ensuring a flow rate required for the supply/discharge of the hydraulic fluid is continuously obtained.

In the aspect of the invention, the sleeve may be formed of a material having a higher coefficient of thermal expansion than the bolt. In this case, when there is a rather wide gap between the sleeve and the bolt during the operation of the flow rate control valve, the amount of the hydraulic fluid leaking out through this gap may increase to cause a deterioration in the flow rate characteristic of the flow rate control valve.

In this manner, however, when a sleeve formed of a material having a higher coefficient of thermal expansion than the bolt is employed as the sleeve, the sleeve expands more than the bolt as the temperature of the hydraulic fluid rises. Accordingly, even in the case where there is a rather wide gap between the sleeve and the bolt when the temperature of the hydraulic fluid is low, the gap narrows as the temperature of the hydraulic fluid rises. Then, in a normal operation temperature range of the flow rate control valve in which the temperature of the hydraulic fluid is high, the gap between the sleeve and the bolt is extremely narrow, so that the hydraulic fluid is restrained from leaking out.

Further, the sleeve may be press-fitted into the insertion portion after the movable member is fastened by the bolt. According to the aforementioned construction, the sleeve is press-fitted into the insertion portion after the movable member is fastened by the bolt. Thus, the sleeve and the spool, which are in charge of the function of a valve, are less susceptible to a fastening torque of the bolt and less likely to become distorted than in the case where the movable member is fastened by the bolt with the sleeve press-fitted in the insertion portion. The gap between the sleeve and the spool has small local dispersion, although not as small as in the case where the sleeve is inserted into the insertion portion in a non-press-fitted state. The change in the flow rate characteristic of the hydraulic fluid resulting from the dispersion of the gap is small.

Further, the sleeve press-fitted in the insertion portion is unlikely to move in the direction along the axis. Thus, the positional relationship between the through hole and the port and the positional relationships between the respective portions of the spool and the through hole axe restrained from deviating in the direction along the axis during the operation or the like of the flow rate control valve, and the flow rate characteristic is restrained from changing as a result of deviation.

Further, the bolt may have one end of the insertion portion in the direction along the axis as an insertion port, and the other end of the insertion portion as an inner bottom portion. The sleeve may be formed shorter than a depth from the insertion port of the insertion portion to the inner bottom portion thereof. The insertion port of the bolt may be formed therearound with an opening end face located on a same plane as a rear end face of the sleeve, which is located on a rear side in an insertion direction, with the port coincident in position with the through hole.

According to the aforementioned construction, when the sleeve is inserted into the insertion portion of the bolt until the rear end face of the sleeve is level with the opening end face of the bolt around the insertion port in forming the housing, the port of the bolt coincides in position with the through hole of the sleeve. In this manner, the rear end face of the sleeve and the opening end face of the bolt function as a positioning reference plane in inserting the sleeve into the insertion portion. The sleeve is thereby positioned in the direction along the axis of the insertion portion.

Further, the rear end face of the sleeve may be pressed by a jig when the sleeve is inserted into the insertion portion, the sleeve may be pressed to a position where that region of a press face of the jig for pressing the sleeve which protrudes from the rear end face is in contact with the opening end face, to position the rear end face of the sleeve on the same plane as the opening end face.

According to the aforementioned construction, when the sleeve is inserted into the insertion portion, the rear end face of the sleeve is pressed by the jig with part of the press face protruding from the rear end face. This pressing is then carried out until that region of the press face which protrudes from the rear end face comes into contact with the opening end face. Due to this pressing, the rear end face of the sleeve is positioned on the same plane as the opening end face.

Further, in the aspect of the invention, the variable mechanism may be a variable valve timing mechanism that changes a rotational phase of a camshaft relative to a crankshaft of the internal combustion engine through operation of the movable member to make the valve timing Of the engine valve variable as the valve opening/closing characteristic.

Further, the housing may be disposed on a same axis as the camshaft, and the movable member may be so disposed as to surround the housing.

In this manner, that region of the flow rate control valve which functions as the valve is disposed in the central region of the variable valve timing mechanism. The spool is close to the movable member, the oil passages for the hydraulic fluid between the spool and the movable member are short, and the areas of the faces to be sealed are small. As a result, the responsiveness in operating the variable valve timing mechanism is enhanced, and oil is restrained from leaking out from the oil passages between the variable mechanism and the flow rate control valve.

Further, the phase adjustment portion may include a non-circular cylindrical annular protrusion protruding from the inner bottom portion of the insertion portion of the bolt toward a insertion port side, and a recess that is provided in the sleeve at a tip end thereof and can have the annular protrusion fitted therein.

Further, the annular protrusion may have an outer wall surface in a shape of an outer wall surface of a polygonal cylinder or an elliptical cylinder.

In this manner, the sleeve is not assembled into the bolt with the corresponding ports of the sleeve and the bolt deviant from each other in the circumferential direction. Further, the sleeve assembled into the bolt does not rotate with respect to the bolt due to vibrations or the like from the internal combustion engine to cause the port of the sleeve to deviate from the port of the bolt in the circumferential direction. Thus, the flow rate required for the supply/discharge of the hydraulic fluid can be ensured.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
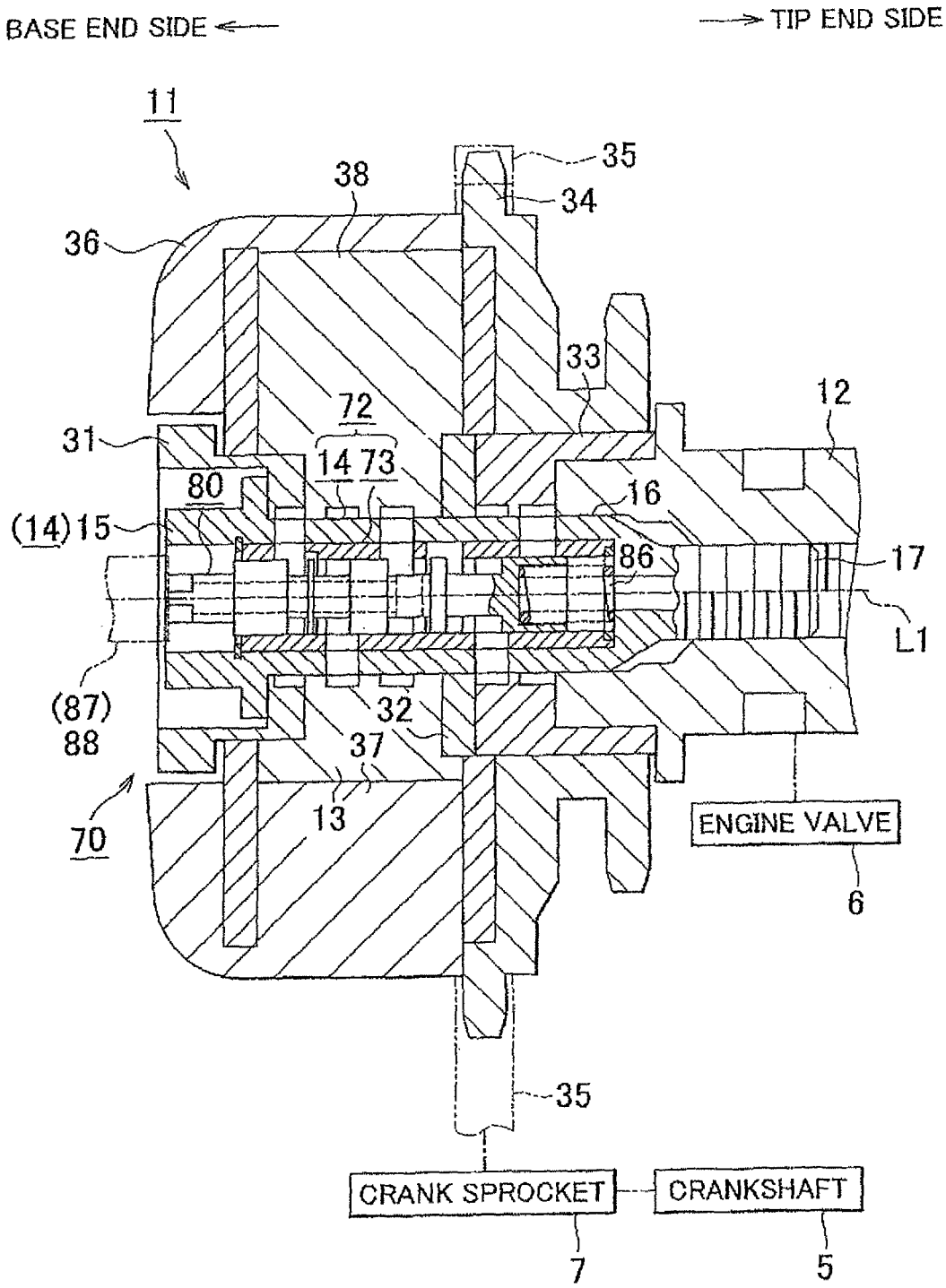
FIG. 1 shows a first embodiment of the invention, more specifically, a partial cross-sectional view of a variable valve timing mechanism to which a flow rate control valve is applied.

The first embodiment of the invention will be described hereinafter with reference to FIGS. 1 to 11. As shown in FIG. 1, an internal combustion engine includes a crankshaft 5, which serves as an output shaft thereof, and a camshaft 12 that actuates the engine valves 6 such as intake valves and exhaust valves in an opening/closing manner. The crankshaft 5 and the camshaft 12 are rotatably supported in the direction indicated by the arrow of FIG. 2.

Figure 2:
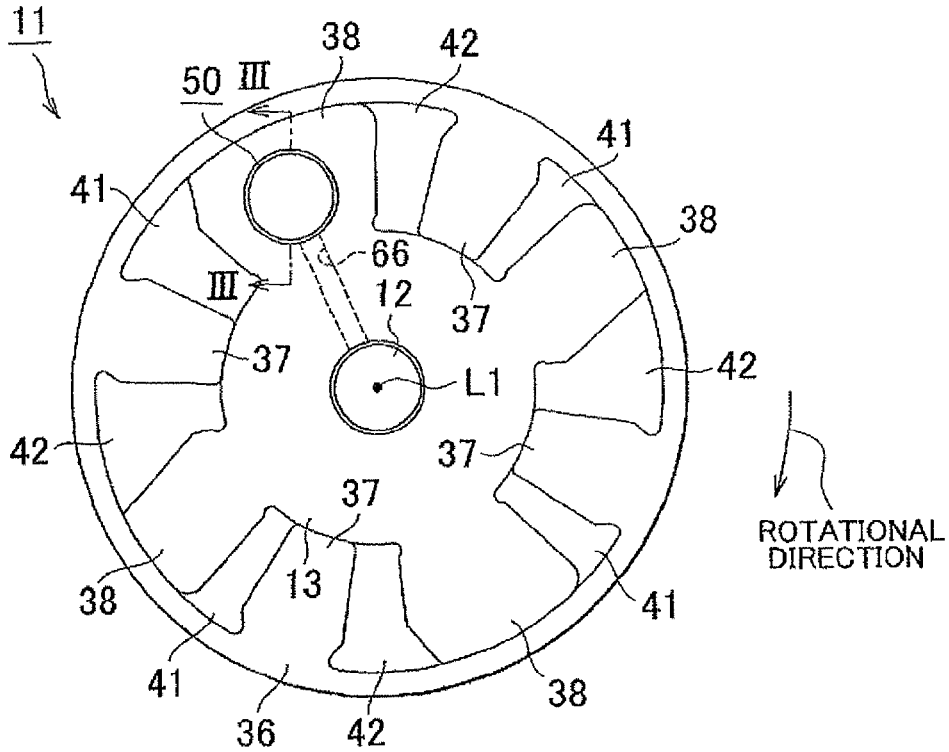
FIG. 2 is a front view showing the overall configuration of the variable valve timing mechanism of FIG. 1 around a movable member.

As shown in at least one of FIGS. 1 and 2, the internal combustion engine is equipped with a variable valve timing mechanism 11. The variable valve timing mechanism 11 changes the rotational phase of the camshaft 12 relative to the crankshaft 5 to vary the valve timing, that is, one of valve opening/closing characteristics of the engine valves 6. The expression to vary the valve timing means that the valve timing may be advanced or retarded while maintaining the duration (i.e., the valve open period) of the engine valves 6 constant.

The left side of FIG. 1 is referred to as "a base end side" and the right side of FIG. 1 is referred to as "a tip end side" to specify the direction along the axis L1 of the camshaft 12. The variable valve timing mechanism 11 is provided at a base end of the camshaft 12, and includes a movable member 13 that operates through the supply and discharge (supply/discharge) of the hydraulic fluid. The movable member 13 is fastened to the camshaft 12 by a bolt 14. The bolt 14 includes a head portion 15 disposed on the axis L1, a tubular wall portion 16 that extends from the head portion 15 toward the tip end, and a screw portion 17 that extends from the tubular wall portion 16 further toward the tip end.

The bolt 14 constructed as described above is inserted, at the tubular wall portion 16 thereof and the screw portion 17 thereof, through the movable member 13. The screw portion 17 is then screwed into the base end of the camshaft 12, and the movable member 13 is sandwiched between the head portion 15 and the camshaft 12.

It should be noted that the axis L1 of the camshaft 12 coincides with respective axes of the bolt 14, a sleeve 73, a spool 80, and the like. Thus, the axis L1 of the camshaft 12 is referred to when describing the respective axes of the bolt 14, the sleeve 73, the spool 80, and the like.

A front bushing 31 is disposed between the movable member 13 and the head portion 15 of the bolt 14. Further, a rear bushing 32 and a support body 33 are disposed between the movable member 13 and the camshaft 12. The front bushing 31, the rear bushing 32, and the support body 33 are integrally rotatably fastened to the camshaft 12 together with the movable member 13 by the bolt 14.

A cam sprocket 34 is relatively rotatably supported around the support body 33. A timing chain 35 is hung around this cam sprocket 34 and the crank sprocket 7 of the crankshaft 5. The rotational driving force of the crankshaft 5 is transmitted to the cam sprocket 34 via the timing chain 35.

A case 36 of the variable valve timing mechanism 11 is fixed to the cam sprocket 34. Thus, when rotation of the crankshaft 5 is transmitted to the cam sprocket 34, the cam sprocket 34 and the case 36 rotate around the axis L1 in the direction indicated by the arrow of FIG. 2. The rotation is transmitted to the camshaft 12 via the hydraulic fluid in the case 36 and the movable member 13. Then, when the movable member 13 is rotated relatively to the case 36, the rotational phase of the camshaft 12 relative to the crankshaft 5 is changed, so that the valve timing of the engine valves 6 is advanced or retarded.

The case 36 surrounds the movable member 13. A plurality of protrusions 37 that protrude toward the axis L1 are formed at predetermined intervals in a circumferential direction on the inner peripheral face of the case 36. Further, a plurality of vanes 38 protruding away from the axis L1 are formed on an outer peripheral face of the movable member 13 such that each of the vanes 38 is positioned between adjacent protrusions 37. The region in the case 36 surrounded by the movable member 13 and the adjacent protrusions 37 is compartmentalized into an advancement chamber 41 and a retardation chamber 42 by the vanes 38.

Then, when the hydraulic fluid is supplied to the advancement chamber 41 and discharged from the retardation chamber 42, the movable member 13 rotates within the case 36 in the clockwise direction of FIG. 2. The rotational phase of the camshaft 12 relative to the crankshaft 5 is changed to the advancement side, so that the valve timing of the engine valves 6 is advanced. When at least one of the vanes 38 abuts on the protrusion 37 located on the front side in the rotational direction and can no longer rotate relatively (reaches a most advanced phase), the valve timing is most advanced.

Further, if the hydraulic fluid is supplied to the retardation chamber 42 and discharged from the advancement chamber 41, the movable member 13 rotates within the case 36 in the counterclockwise direction of FIG. 2. The rotational phase of the camshaft 12 relative to the crankshaft 5 is changed to the retardation side, so that the valve timing of the engine valves 6 is retarded. When at least one of the vanes 38 abuts on the protrusion 37 located on the rear side in the rotational direction and can no longer rotate relatively (reaches a most retarded phase), the valve timing is most retarded.

Figure 3:
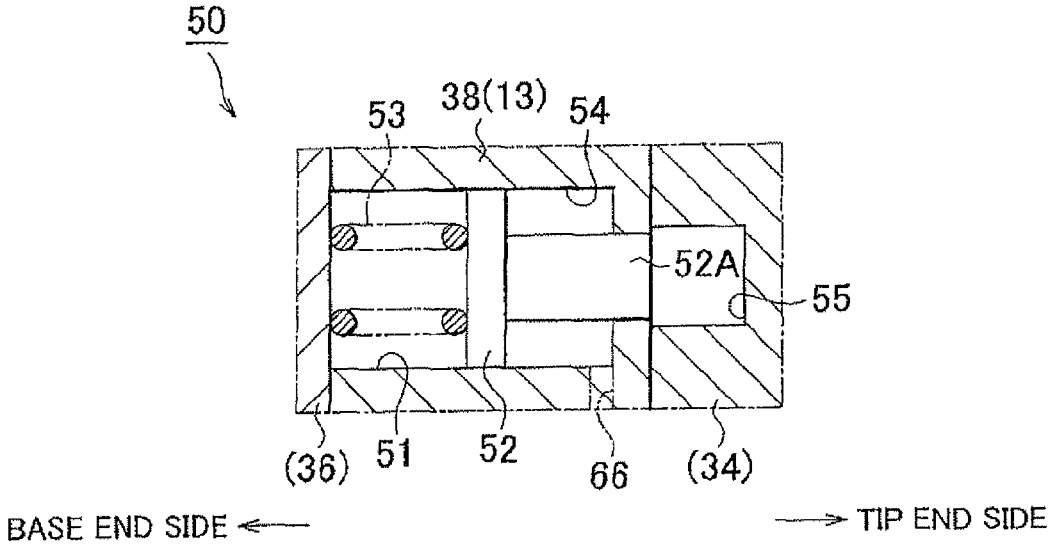
FIG. 3 is a partial cross-sectional view showing the cross-sectional structure along the line III-III of FIG. 2.

Further, as Shown in FIGS. 2 and 3, the variable valve timing mechanism 11 includes a lock mechanism 50. The lock mechanism 50 is a mechanism that maintains the rotational phase of the movable member 13 relative to the case 36 at an intermediate phase between the most advanced phase and the most retarded phase, regardless of the magnitude of the oil pressure in the advancement chamber 41 and the retardation chamber 42. Because the movable member 13 is thus maintained in the intermediate phase, the valve timings are held at an intermediate angle between the most advanced angle and the most retarded angle. It should be noted that the intermediate angle (the intermediate phase) is set such that the valve overlap of the valve timing for the intake valves and the valve timing for the exhaust valves becomes appropriate at engine starting and during idling.

Next, the lock mechanism 50 will be described. An accommodation space 51 extending in the direction along the axis L1 is formed in one of the plurality of the vanes 38, and a lock pin 52 is accommodated in the accommodation space 51. A lock spring 53 that urges the lock pin 52 toward the cam sprocket 34 so that one end 52A of the lock pin 52 protrudes from the accommodation space 51 toward the tip end is accommodated in the accommodation space 51. Further, the region of the accommodation space 51 located on the other side of the lock spring 53 across the lock pin 52 serves as a release chamber 54 to which the hydraulic fluid is supplied. The lock pin 52 is urged against the elastic force of the lock spring 53 by the oil pressure in the release chamber 54. In contrast, a lock hole 55, into/from which the end 52A of the lock pin 52 is fitted/disengaged when the rotational phase of the movable member 13 relative to the case 36 equals the intermediate phase (when the valve timings become equal to the intermediate angle), is formed through a member that rotates integrally with the crankshaft 5, for example, the cam sprocket 34.

In the lock mechanism 50, when the rotational phase of the movable member 13 relative to the case 36 is in the intermediate phase, if the hydraulic fluid is discharged from the release chamber 54 and the oil pressure in the release chamber 54 decreases, the lock pin 52 is urged by the lock spring 53 to protrude from the accommodation space 51 and to fit into the lock hole 55 at the end 52A. Accordingly, the lock mechanism 55 is locked to hold the valve timings at the intermediate angle. In contrast, if the hydraulic fluid is supplied to the release chamber 54 so that the oil pressure in the release chamber 54 increases while the lock mechanism 50 is locked, the lock pin 52 is urged against the urging of the lock spring 53 by the oil pressure, to disengage from the lock hole 55, and is then accommodated in the accommodation space 51. Accordingly, the lock mechanism 50 is unlocked, so that the valve timing may be adjusted in accordance with the supply/discharge state of the hydraulic fluid to/from the advancement chamber 41 and the retardation chamber 42.

Figure 4:
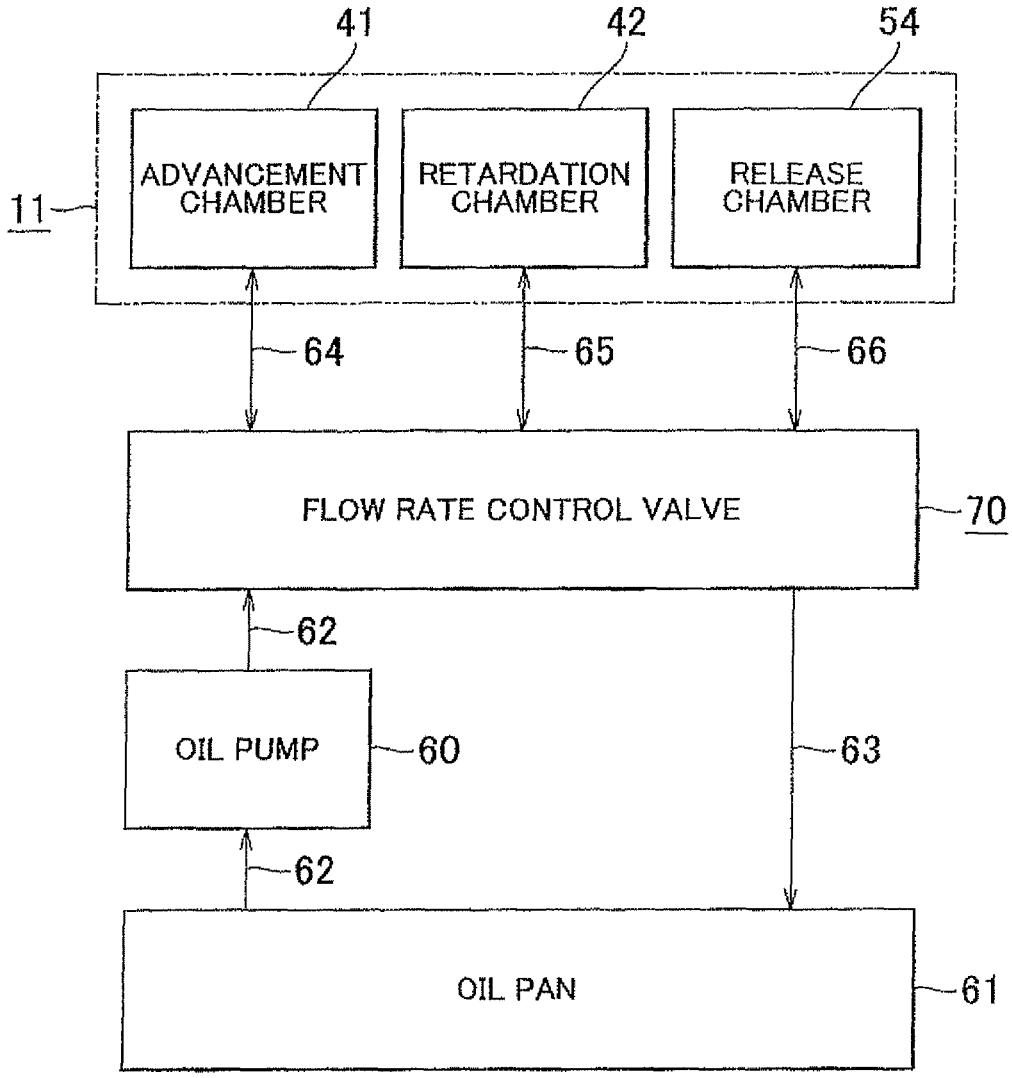
FIG. 4 is a schematic view showing a supply/discharge state of the hydraulic fluid for an advancement chamber, a retardation chamber, and a release chamber in the variable valve timing mechanism according to the first embodiment of the invention.

As shown in FIG. 4, to supply/discharge the hydraulic fluid to/from the advancement chamber 41, the retardation chamber 42, and the release chamber 54, a flow rate control valve (an oil control valve) 70 is provided across a plurality of oil passages that join the variable valve timing mechanism 11 to an oil pump 60. The plurality of the oil passages are a oil supply passage 62, a oil discharge passage 63, an advancement oil passage 64, a retardation oil passage 65, and a release oil passage 66.

The oil supply passage 62 introduces the hydraulic fluid in the oil pan 61, which is pumped out from the oil pump 60, to the flow rate control valve 70. The oil discharge passage 63 returns the hydraulic fluid discharged from the variable valve timing mechanism 11 through the flow rate control valve 70 to the oil pan 61. The advancement oil passage 64 joins the flow rate control valve 70 to each advancement chamber 41. The retardation oil passage 65 joins the flow rate control valve 70 to each retardation chamber 42. The release oil passage 66 joins the flow rate control valve 70 to the release chamber 54.

Figure 5:
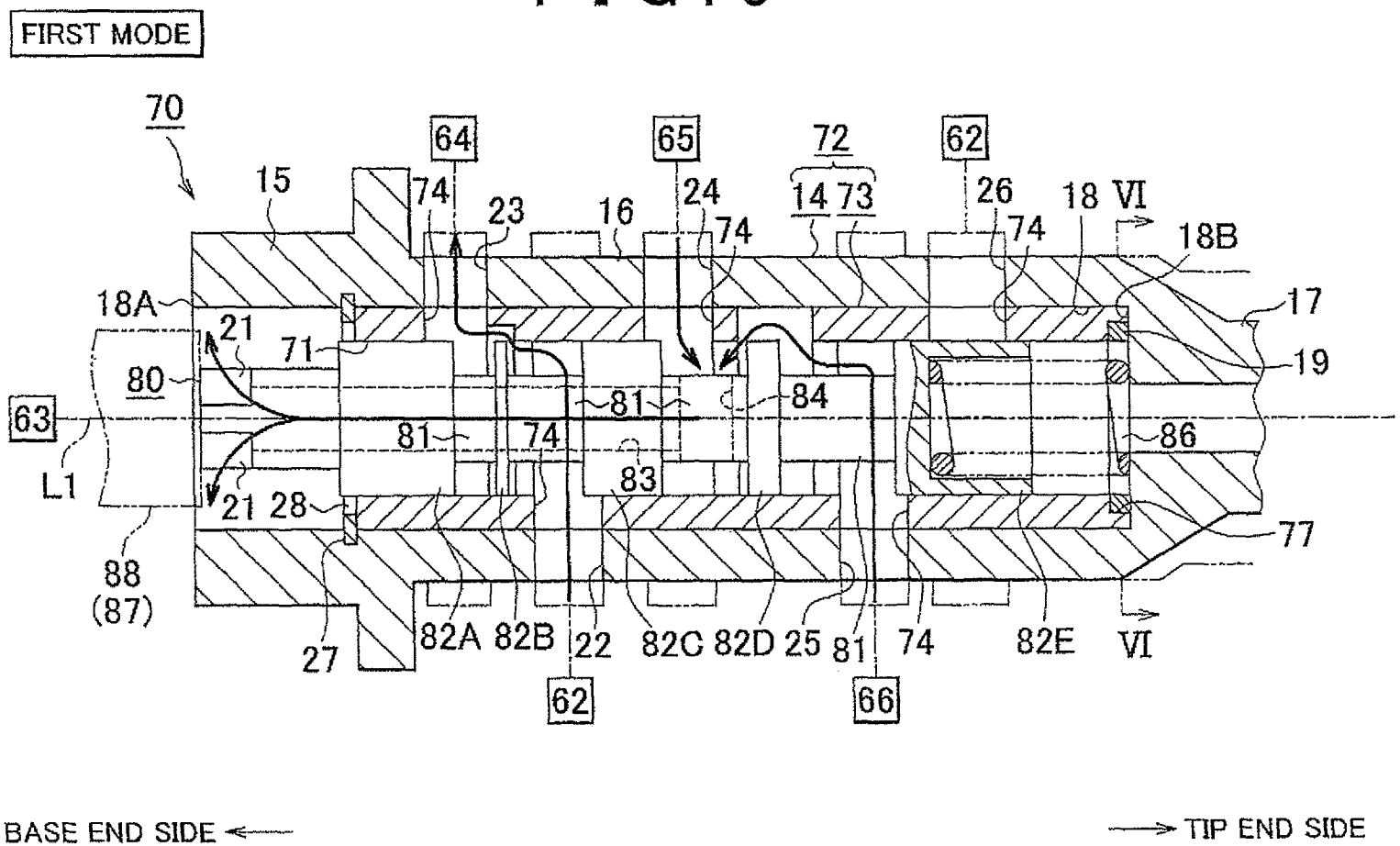
FIG. 5 is a partial cross-sectional view showing the internal structure of the flow rate control valve according to the first embodiment of the invention when a supply/discharge state thereof is in a first mode.

As shown in FIG. 5, the ends of the respective oil passages 62 and 64 to 66 which are located on the flow rate control valve 70 side are annularly formed to surround the tubular wall 16 of the bolt 14. The flow rate control valve 70 includes a housing 72 that has an accommodation chamber 71 in communication with the respective oil passages 62 to 66 and a spool 80, accommodated in the accommodation chamber 71, that reciprocates in the direction along the axis L1. The flow rate control valve 70 then changes the supply/discharge mode of the hydraulic fluid in accordance with the position of the spool 80 to control the valve timings.

In this embodiment of the invention, the housing 72 of the flow rate control valve 70 is disposed in a central region of the variable valve timing mechanism 11 (on the same line as the axis L1) to enhance the responsiveness in actuating the variable valve timing mechanism 11 and restraining the leakage of oil from the oil passages between the variable mechanism 11 and the flow rate control valve 70.

The housing 72 is composed of the bolt 14 and the sleeve 73. A space of the bolt 14 inside the tubular wall portion 16 constitutes an insertion portion 18 assuming the shape of a bottomed circular cylinder with one end (a left end in FIG. 5) serving as an insertion port 18A and the other end (a right end in FIG. 5) serving as an inner bottom portion 18B. The insertion portion 18 has a uniform inner diameter at any location in the direction along the axis L1.

A plurality of types of ports through which the oil passages 62 and 64 to 66 communicate with the insertion portion 18, respectively, are formed in the tubular wall portion 16 of the bolt 14 at a plurality of locations (five locations in this embodiment of the invention) in the direction along the axis L1. The types of ports vary depending on the locations in the direction along the axis L1. At least one port (a plurality of ports in this embodiments of the invention) is provided at each of the locations. In this embodiment of the invention, a plurality of ports is provided at each location substantially at equal angular intervals around the axis L1.

The plurality of the types of the ports described above include an advancement port 23 to which the advancement oil passage 64 is connected, a supply port 22 to which the oil supply passage 62 is connected, a retardation port 24 to which the retardation oil passage 65 is connected, a release oil port 25 to which the release oil passage 66 is connected, and another supply port 26 to which the oil supply passage 62 is connected. The supply port 22 supplies hydraulic fluid to the advancement oil passage 64 via the advancement port 23 (see FIG. 5) or to the retardation oil passage 65 via the retardation port 24 (see FIG. 11) in accordance with the position of the spool 80. The other supply port 26 supplies hydraulic fluid to the release oil passage 66 via the release oil port 25 (see FIGS. 9 to 11).

It should be noted that the flow rate control valve 70 includes a discharge port 21 formed at the base end of the spool 80 through which hydraulic fluid is discharged to the discharge oil passage 63, in addition to the ports 22 to 26 of the bolt 14 (the tubular wall portion 16).

The sleeve 73 is generally formed as a circular cylinder extending in the direction along the axis L1 and is open at both ends. The outer diameter of the sleeve 73 is substantially equal to the inner diameter of the tubular wall portion 16, and an inner diameter of the sleeve 73 is substantially equal to the outer diameter of valves 82A to 82E of the spool 80. The inner space of this sleeve 73 constitutes the accommodation chamber 71. The sleeve 73 is then inserted in the insertion portion 18 of the bolt 14.

A plurality of through holes 74 are formed in the sleeve 73, which is inserted in the insertion portion 18, inward of the ports 22 to 26. The through holes 74 are provided at the same locations as the ports 22 to 26 respectively in the direction along the axis L1. Further, the through holes 74 include at least locations on the inner peripheral side of the corresponding ports 22 to 26 respectively in the circumferential direction of the sleeve 73. In this embodiment of the invention, the length of each through hole 74 is longer than the corresponding port 22 to 26 in the circumferential direction of the sleeve 73. When the sleeve 73 has been inserted in the insertion portion 18, the sleeve 73 is in contact with or close to the inner wall surface of the insertion portion 18 at locations except the through holes 74.

In this case, because both the inner wall surface of the insertion portion 18 and the outer wall surface of the sleeve 73 assume a circular cylindrical shape, the sleeve 73 may be assembled into the bolt 14 with the state of the through holes 74 being deviant from the corresponding ports 22 to 26 respectively in the circumferential direction. Further, the sleeve 73 assembled into the bolt 14 may rotate relatively to the bolt 14 due to vibrations or the like from the internal combustion engine, thereby causing the through holes 74 to deviate from the ports 22 to 26 in the circumferential direction.

Figure 6:
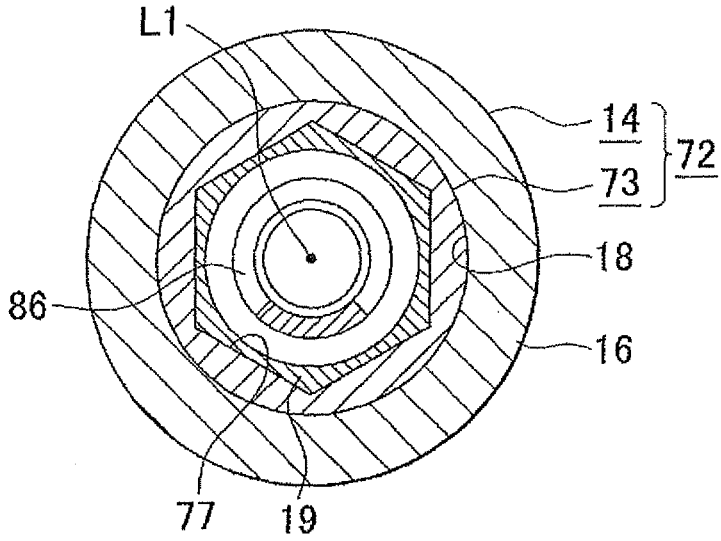
FIG. 6 is a cross-sectional view of the structure along the line VI-VI of FIG. 5.

Thus, in the embodiment of the invention, as shown in FIGS. 5 and 6, the housing 72 is provided with a phase adjustment portion that adjusts the rotational phase of the sleeve 73 with respect to the bolt 14 to a phase in which the ports 22 to 26 coincide in position with the through holes 74 respectively, and holds the phase of the rotation of the sleeve 73 with respect to the bolt 14 equal thereto. The phase adjustment portion is composed of an annular protrusion 19 that protrudes toward the base end from the inner bottom portion 18B of the insertion portion 18 of the bolt 14, and a recess 77 that is formed at the tip end in the sleeve 73, into which the annular protrusion 19 fits. Both the outer wall surface of the annular protrusion 19 and the inner wall surface of the recess 77 assume the shape of an outer wall surface of a hexagonal cylinder as one form of a non-circular cylinder, and are formed as to satisfy the following condition. The condition is that the recess 77 be allowed to have the annular protrusion 19 fitted therein when the phase of rotation of the sleeve 73 with respect to the bolt 14 becomes equal to the phase in which the ports 22 to 26 coincide in position as a whole with the through holes 74 respectively.

Then, when being assembled into the bolt 14, the sleeve 73 has the recess 77 having the annular protrusion 19 fitted therein with the phase of rotation of the sleeve 73 with respect to the bolt 14 adjusted, and the inner bottom face of the recess 77 abuts on the annular protrusion 19. Accordingly, the ports 22 to 26 coincide in position as a whole with the corresponding through holes 74 respectively, and are not blocked by those locations of the sleeve 73, which are not provided with the through holes 74.

Furthermore, in order to stop the sleeve 73 from moving toward the base end with respect to the bolt 14, an annular groove 27 extending in the circumferential direction is formed in the inner wall surface of the insertion portion 18, near the insertion port 18A. An outer peripheral region of a C-ring 28 is fitted in this annular groove portion 27. An inner peripheral region of the C-ring 28 is exposed from the groove portion 27 and is in contact with or close to the sleeve 73.

The spool 80 is elongated in the direction along the axis L1. The spool 80 is equipped with a plurality of valves disposed apart from one another in the direction along the axis L1 and having an outer diameter substantially equal to the inner diameter of the sleeve 73 (the accommodation chamber 71), and a plurality of small-diameter portions 81 disposed apart from one another in the direction and having an outer diameter smaller than the outer diameter of the valves. In this case, to make a distinction, the plurality of the valves are referred to as a first valve 82A, a second valve 82B, a third valve 82C, a fourth valve 82D, and a fifth valve 82E respectively in the recited order from the base of the spool 80 toward the tip of the spool 80. The valves 82A to 82E and the small-diameter portions 81 are alternately disposed in the direction along the axis L1.

A discharge hole 83 that opens to a base end face of the spool 80 and extends toward the tip on the axis L1 is formed through the spool 80. The spool 80 has formed therethrough an introduction hole 84 through which an outer peripheral face of the small-diameter portion 81 between the third valve 82C and the fourth valve 82D and the aforementioned discharge hole 83 communicate with each other.

The valves 82A to 82E open or close the ports 22 to 26 and the through holes 74, or change the opening amount of the ports 22 to 26 respectively. It should be noted that these open/closed states of the ports 22 to 26 are determined respectively in accordance with the positional relationships of the valves 82A to 82E to the ports 22 to 26, in other words, the position of the spool 80 in the direction along the axis L1.

That is, when being opened by the first valve 82A, the advancement port 23 communicates with one of the supply port 22 and the discharge oil passage 63 (see FIGS. 5, 8, 9, and 11). Further, when being opened by the third valve 82C, the retardation port 24 communicates with the discharge port 21 via the introduction hole 84 and the discharge hole 83 (see FIGS. 5, 8, and 9) or communicates with the supply port 22 (see FIG. 11). Further, when being opened by the fifth valve 82E, the supply port 26 communicates with the release oil port 25 (see FIGS. 9 to 11). Further, when being opened by the fifth valve 82E, the release oil port 25 communicates with the discharge port 21 via the introduction hole 84 and the discharge hole 83 (see FIGS. 5 and 8) or communicates with the supply port 26 (see FIGS. 9 to 11). It should be noted that the second valve 82B and the fourth valve 82D more finely adjust the amounts of the hydraulic fluid supplied/discharged to/from the advancement chamber 41, the retardation chamber 42, and the release chamber 54 through the advancement oil passage 64, the retardation oil passage 65, and the release oil passage 66 respectively.

Then, the amount of the hydraulic fluid supplied/discharged to/from the advancement chamber 41, the retardation chamber 42, and the release chamber 54 are thus adjusted. A changeover between a state in which the valve timings are advanced and a state in which the valve timings are retarded, a fitting/disengagement state of the lock pin 52 with respect to the lock hole 55, and the like are thereby adjusted.

It should be noted that the position of the flow rate control valve 70 when the spool 80 is located closest to the base end of the housing 72 is defined as the initial position, and the amount of displacement of the spool 80 from the initial position toward the tip end is defined. The supply/discharge state of the flow rate control valve 70 is then set to one of first to fifth modes in accordance with the amount of displacement of the spool 80.

It should be noted that the flow rate control valve 70 includes a spring 86 and an electromagnetically driven actuator 87. The spring 86 is disposed between the spool 80 and the inner bottom portion 18B of the insertion portion 18, and urges the spool 80 toward the base end when compressed.

The actuator 87 includes a shaft 88 that reciprocates in the direction along the axis L1. When the actuator 87 is energized, it generates an electromagnetic force that moves the shaft 88 toward the tip end, thereby pressing the shaft 88 against the spool 80. When the pressing force of the shaft 88 applied to the spool 80 is adjusted through this electromagnetic force, the spool 80 moves in the direction along the axis L1 until the pressing force becomes equal to the urging force of the spring 86, and the amount of displacement of the spool 80 is determined.

Next, the first operation mode of the flow rate control valve 70 will be described. When the spool 80 is at the initial position shown in FIG. 5, the advancement port 23 is in communication with the supply port 22, and is out of communication with the discharge oil passage 63 by the first valve 82A. In addition, the retardation port 24 is communicated with the discharge port 21 via the introduction hole 84 and the discharge hole 83, and communication with the supply port 22 is blocked by the third valve 82C. Furthermore, the release, oil port 25 is communicated with the discharge port 21 via the introduction hole 84 and the discharge hole 83, and communication with the supply port 26 is blocked by the fifth valve 82E.

Figure 7:
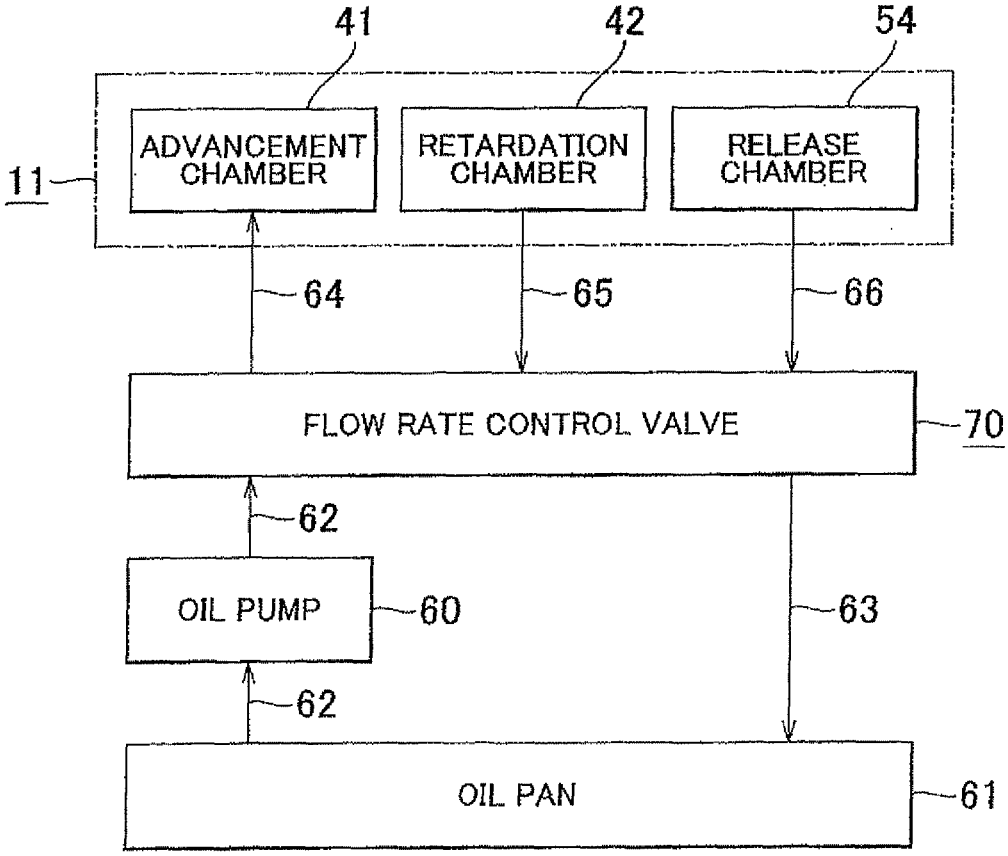
FIG. 7 is a schematic view showing the flow of the hydraulic fluid when the supply/discharge state of the flow rate control valve according to the first embodiment of the invention is in the first mode.
Figures 8A, 8B:
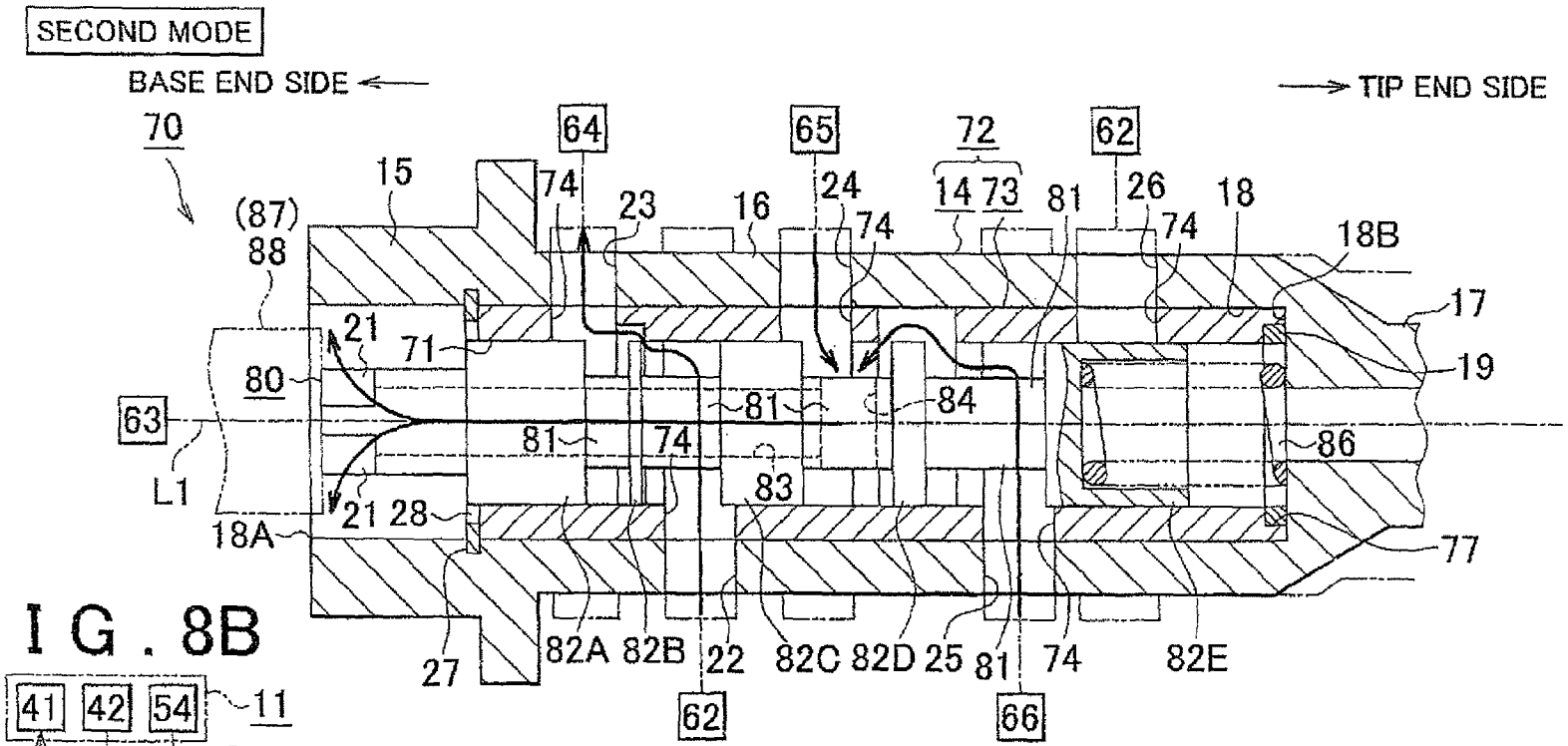
FIG. 8A is a partial cross-sectional view of the internal structure of the flow rate control valve according to the first embodiment of the invention when the supply/discharge state thereof is in a second mode.
FIG. 8B is a schematic view showing the flow of the hydraulic fluid.
Figure 9A:
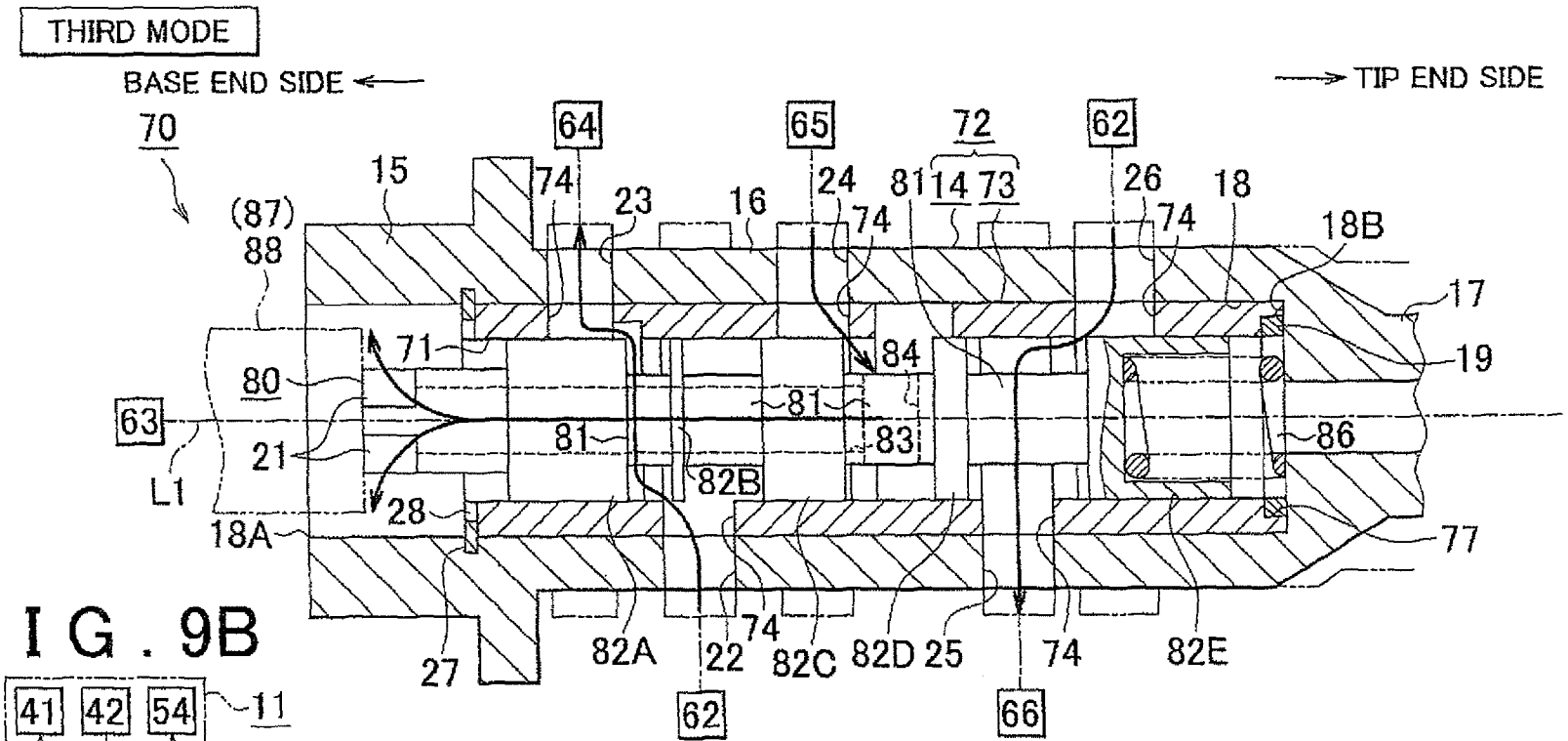
FIG. 9A is a partial cross-sectional view of the internal structure of the flow rate control valve according to the first embodiment of the invention when the supply/discharge state thereof is in a third mode.
Figure 9B:
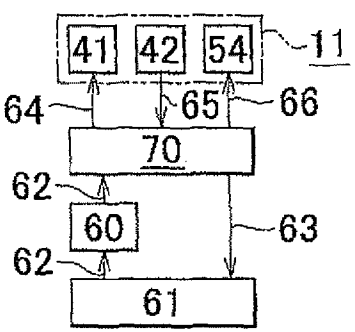
FIG. 9B is a schematic view showing the flow of the hydraulic fluid.
Figure 10A:
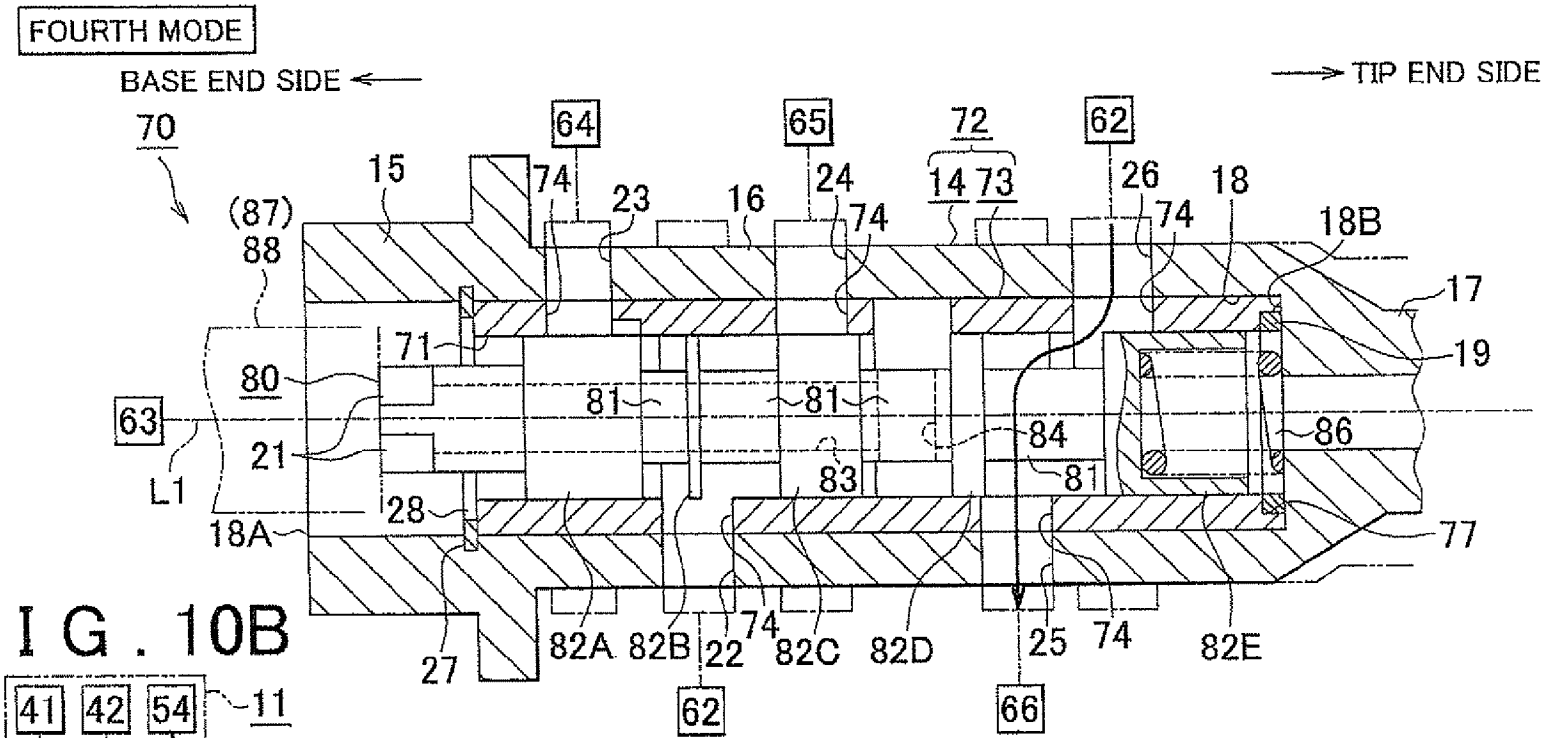
FIG. 10A is a partial cross-sectional view of the internal structure of the flow rate control valve according to the first embodiment of the invention when the supply/discharge state thereof is in a fourth mode.
Figure 10B:
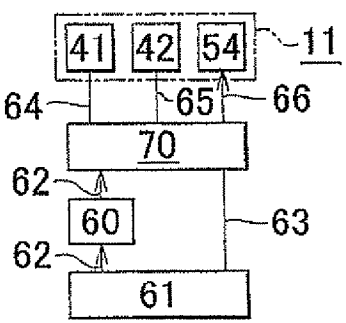
FIG. 10B is a schematic view showing the flow of the hydraulic fluid.
Figure 11A:
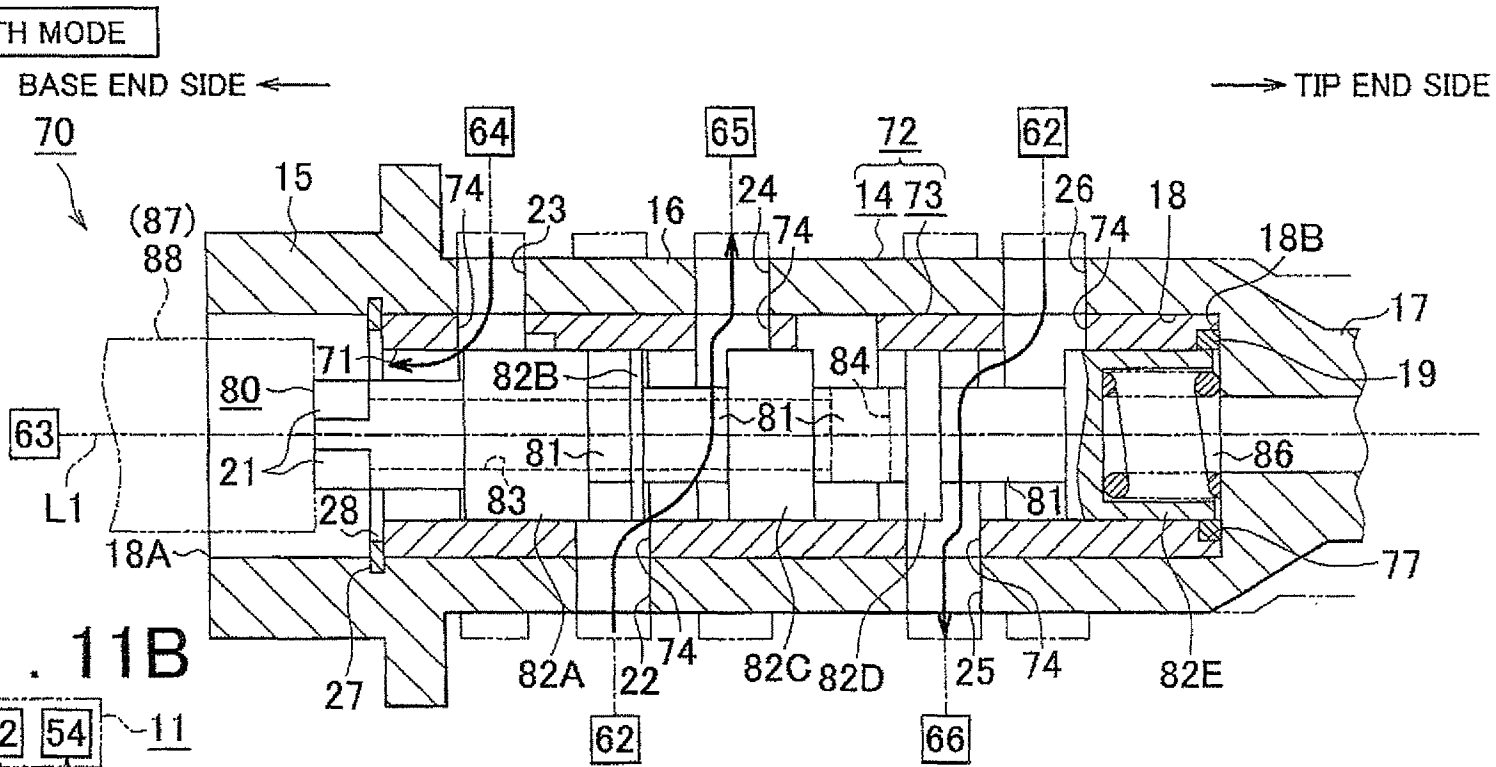
FIG. 11A is a partial cross-sectional view of the internal structure of the flow rate control valve according to the first embodiment of the invention when the supply/discharge state thereof is in a fifth mode.
Figure 11B:
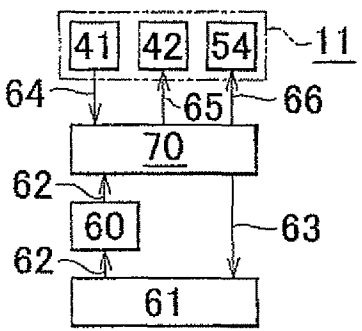
FIG. 11B is a schematic view showing the flow of the hydraulic fluid.

With the ports in the communication/shutoff states described above, the hydraulic fluid is supplied from the oil pump 60 to the advancement chamber 41 through the supply oil passage 62, the supply port 22, the advancement port 23, and the advancement oil passage 64 sequentially as indicated by the arrows in FIGS. 5 and 7. The hydraulic fluid in the retardation chamber 42 flows through the retardation oil passage 65, the retardation port 24, the introduction hole 84, the discharge hole 83, the discharge port 21, and the discharge oil passage 63 in the recited order before being returned to the oil pan 61. In addition, the hydraulic fluid in the release chamber 54 flows through the release oil passage 66, the release oil port 25, the introduction hole 84, the discharge hole 83, the discharge port 21, and the discharge oil passage 63 in the recited order before being returned to the oil pan 61.

It should be noted that the first mode is set, for example, when the engine is normally started after the engine stopped with the lock mechanism 50 being in locked state. The second to fifth modes are shown in FIGS. 8A to 11B. Each of FIGS. 8A, 9A, 10A, and 11A shows a state inside the flow rate control valve 70 in a manner corresponding to FIG. 5. Each of FIGS. 8B, 9B, 10B, and 11B shows the flow of the hydraulic fluid in a manner corresponding to FIG. 7.

In an internal combustion engine, one of first to fifth modes is selected/set in accordance with the engine operation state to optimize engine combustion and an increase in engine output. For example, when the amount of internal EGR is increased to reduce pumping loss, the third mode is set to advance the valve timings. In contrast, when the blowback of exhaust gas is suppressed to enhance intake efficiency, the fifth mode is set to retard the valve timings. Then, when the valve timings coincide with target timings respectively, the fourth mode is set to maintain the valve timings.

Besides, for example, in shifting the internal combustion engine to idle operation, if the lock pin 52 is located on the retardation side with respect to the lock hole 55, the second mode is set. In contrast, if the lock pin 52 is located on the advancement side with respect to the lock hole 55, the fifth mode is temporarily set to retard the valve timings before the second mode is set. By thus setting the modes, the valve timings are gradually advanced, and the hydraulic fluid is discharged from the release chamber 54. As a result, when the lock hole 55 and the lock pin 52 coincide in position with each other in the circumferential direction, namely, when the valve timings become equal to the intermediate angle, the lock pin 52 is fitted into the lock hole 55 to maintain the valve timings at the intermediate angle.

It should be noted that because the lock pin 52 is fitted in the lock hole 55 to maintain the valve timings at the intermediate angle while the engine is idling, the operation of the engine is stopped with the valve timings fixed to the intermediate angle when the engine is normally stopped, namely, when the operation of the engine is stopped temporarily via idle operation.

Meanwhile, when the housing 72 is screwed into the camshaft 12 to fasten the movable member 13 to the camshaft 12, the flow rate control valve 70 may be deformed such that the bolt 14 is distorted by a fastening torque and curved with respect to the axis L1 as a result of a manufacturing error of the movable member 13, an assembly error of the movable member 13, manufacturing errors of the bolt 14 and the camshaft 12, or the like. If the housing 72 is composed solely of the bolt 14, the gap between the housing 72 and the spool 80 greatly varies locally to cause an apprehension that the flow rate characteristic of the hydraulic fluid may change or that the spool 80 may fail to operate properly.

In this respect, according to the first embodiment of the invention in which the housing 72 of the flow rate control valve 70 is composed of the bolt 14 and the sleeve 73, as shown in FIG. 1, the sleeve 73 is interposed between the bolt 14 and the spool 80. The housing 72 of the flow rate control valve 70 performs the fastening function of the movable member 13 and the valve function. While the bolt 14 is in charge of the fastening function, the sleeve 73 and the spool 80 are in charge of the valve function. In this manner, the separate members are in charge of the fastening function of the housing 72 and the valve function of the housing 72 respectively. Accordingly, the sleeve 73 and the spool 80, which are in charge of the valve function, is unsusceptible to the influence of the fastening torque of the bolt 14, which is in charge of the fastening function, and hence is unlikely to be distorted. The gap between the sleeve 73 and the spool 80 does not greatly vary locally in the direction along the axis L1, and thus changes in the flow rate characteristic of the flow rate control valve 70 are minimal.

Further, as shown in FIG. 5, when assembled with the bolt 14, the sleeve 73 inserted in the insertion portion 18 has the recess 77 fitted to the annular protrusion 19. In this fitting state, the phase of rotation of the sleeve 73 with respect to the bolt 14 is adjusted, and the overall position of the ports 22 to 26 coincide with the corresponding through holes 74 and are not blocked by those regions of the sleeve 73 which are not provided with the through holes 74 respectively. The oil passages 62 and 64 to 66 for supplying/discharging the hydraulic fluid are in communication with the accommodation chamber 71 in the sleeve 73 through the ports 22 to 26 and the through holes 74 respectively.

In addition, rotation of the sleeve 73 with respect to the bolt 14 is stopped by the annular protrusion 19 having the non circular cylindrical outer wall surface. By preventing rotation of the sleeve 73, it is remains in phase even after having been adjusted in phase thereto. Accordingly, even if a force acts to rotate the sleeve 73 due to vibrations or the like of the internal combustion engine, the ports 22 to 26 remain in position with respect to the corresponding through holes 74 due to the maintenance of the aforementioned phase.

Furthermore, the inner bottom face of the recess 77 of the sleeve 73 is in contact with or close to the annular protrusion 19 of the bolt 14, and is stopped from moving further toward the tip end side in the direction along the axis L1. Further, the sleeve 73 comes into contact with or close to the inner peripheral region of the C-ring 28 projects from the annular groove portion 27, and thus is stopped from moving further toward the base end in the direction along the axis L1 by the C-ring 28. Being thus stopped from moving, the sleeve 73 is immovable toward both sides in the direction along the axis L1. In the direction along the axis L1, the positional relationships between the valves 82A to 82E and small-diameter portion 81 of the spool 80 and the through holes 74 in the sleeve 73 are held equal to initial positional relationships respectively regardless of vibrations or the like of the internal combustion engine.

According to the first embodiment of the invention described above in detail, the following effects are obtained.

(1) The housing 72 of the flow rate control valve 70 is composed of the bolt 14 for fastening the movable member 13 to the camshaft 12, and the sleeve 73 inserted in the insertion portion 18 of the bolt 14 and having the accommodation chamber 71 (FIGS. 1 and 5). Thus, even when the bolt 14 is distorted by the fastening torque in fastening the movable member 13, the change in the flow rate characteristic resulting from the dispersion of the gap between the sleeve 73 and the spool 80 and the operational failure in the spool 80 is minimal.

(2) The bolt 14 includes the plurality of ports 22 to 26, through which the oil passages 62 and 64 to 66 communicate with the insertion portion 18 respectively, and the sleeve 73 includes the plurality of the through holes 74, which passes through the sleeve wall. Furthermore, the phase adjustment portion (the annular protrusion 19 and the recess 77) used to adjust the phase of rotation of the sleeve 73 with respect to the bolt 14 to the phase in which the ports 22 to 26 coincide in position as a whole with the through hole 74 respectively and holds the phase of rotation of the sleeve 73 with respect to the bolt 14 equal thereto is provided (FIG. 5).

Thus, when the rotational phase of the sleeve 73 with respect to the bolt 14 is adjusted by the phase adjustment portion, the ports 22 to 26 can thereby be made to coincide in position as a whole with the corresponding through holes 74 respectively. The sleeve 73 can be restrained from being assembled with the bolt 14 with the through holes 74 deviant from the corresponding ports 22 to 26 respectively in the circumferential direction. The oil passages 62 and 64 to 66 for the supply/discharge of the hydraulic fluid can be made in communication with the accommodation chamber 71 in the sleeve 73 through the ports 22 to 26 and the through holes 74 respectively, and a flow rate required for the supply/discharge of the hydraulic fluid can be ensured.

Further, the phase adjustment portion stops the sleeve 73 adjusted in phase from rotating with respect to the bolt 14. The sleeve 73 assembled with the bolt 14 can thereby be restrained from rotating with respect to the bolt 14 due to vibrations or the like of the internal combustion engine to deviate the through holes 74 from the ports 22 to 26 in the circumferential direction respectively. The ports 22 to 26 can be made to continue to coincide in position as a whole with the corresponding through holes 74 respectively, and the foregoing effect of ensuring the flow rate required for the supply/discharge of the hydraulic fluid can be continuously obtained.

(3) The annular protrusion 19 provided on the inner bottom portion 18 of the bolt 14 and the recess 77 provided in the sleeve 73 at the tip end constitute the phase adjustment portion (FIGS. 5 and 6). Thus, by simply fitting the annular protrusion 19 into the recess 77 of the sleeve 73, the phase of the sleeve 73 may be adjusted such that the position of the ports 22 to 26 coincide with the corresponding through holes 74.

(4) The through holes 74 are formed longer than the corresponding ports 22 to 26 respectively in the circumferential direction of the sleeve 73 (FIG. 5 and the like). Thus, even when there is a manufacturing error of the annular protrusion 19, a manufacturing error of the recess 77, or the like, the ports 22 to 26 can be reliably made to coincide in position as a whole with the corresponding through holes 74 respectively by fitting the annular protrusion 19 in the recess 77 to carry out phase adjustment.

(5) The annular groove 27 extending in the circumferential direction is formed in the inner wall surface of the insertion portion 18 of the bolt 14, and the outer peripheral region of the C-ring 28 is fitted in the groove 27 to projects from the inner peripheral region of the C-ring 28 from the groove 27. Further, an annular protrusion 19 is formed in the inner bottom portion 18B of the insertion portion 18 of the bolt 14. The C-ring 28 and the annular protrusion 19 sandwich the sleeve 73 from both the sides thereof in the direction along the axis L1 (FIG. 5). Thus, movement of the sleeve 73 in the direction along the axis L1 due to, for example, vibrations of the internal combustion engine, may be stopped. As a result, the positional relationships between the valves 82A to 82E and small-diameter portion 81 of the spool 80 and the through holes 74 of the sleeve 73 can be restrained from deviating in the direction along the axis L1, which could cause the flow rate characteristic of the flow rate control valve 70 to change and thereby adversely affect controllability.

(6) The housing 72 (the sleeve 14 and the sleeve 73) is disposed on the same axis L1, as the camshaft 12, and the movable member 13 is so disposed as to surround the housing 72. The region of the flow rate control valve 70 that functions as the valve (the bolt 14 and the spool 80) is thereby disposed in the central region of the variable valve timing mechanism 11 (FIG. 1). Thus, the responsiveness in actuating the variable valve timing mechanism 11 is enhanced, and the leakage of oil from the oil passages between the variable mechanism 11 and the flow rate control valve 70 is restrained.

It should be noted that the variable valve timing mechanism 11 of the above type, which performs advancement/retardation control and the control of the lock pin 52 through the single spool 80, has a larger number of oil passages and is more likely to cause deviation of the through holes 74 from the ports 22 to 26 in the circumferential direction or in the direction along the axis L1 or the like than a variable valve timing mechanism that performs only advancement/retardation control. Thus, the first embodiment of the invention, in which the phase adjustment portion adjusts the phase of rotation of the sleeve 73 or stops the sleeve 73 from moving in the direction along the axis L1, is especially effective in the variable valve timing mechanism 11 of the above-described type. This also holds true for later-described second to fourth embodiments of the invention.

Next, a second embodiment of the invention as another concrete form thereof will be described. In the second embodiment of the invention, the sleeve 73 is made of a material having a higher coefficient of thermal expansion than the bolt 14, but is otherwise configured identically to the foregoing first embodiment. More specifically, the bolt 14 is formed of a ferreous material such as iron and steel or the like, and the sleeve 73 is formed of aluminum.

This configuration is adopted because if there is a rather wide gap between the sleeve 73 and the bolt 14 during the operation of the flow rate control valve 70, the amount of the hydraulic fluid leaking through the gap may increase to an extent that degrades the flow rate characteristic of the flow rate control valve 70.

If a sleeve formed of a material having a higher coefficient of thermal expansion than the bolt 14 is employed as the sleeve 73, the sleeve 73 expands more than the bolt 14 as the temperature of the hydraulic fluid rises. Accordingly, even when there is a rather wide gap between the sleeve 73 and the bolt 14 when the temperature of the hydraulic fluid is low (e.g., during the cold start of the internal combustion engine), the gap decreases as the temperature of the hydraulic fluid rises. Then, in the normal operating temperature range of the flow rate control valve 70 in which the temperature of the hydraulic fluid is high, the gap between the sleeve 73 and the bolt 14 is extremely narrow.

It should be noted that if the gap between the sleeve 73 and the bolt 14 is already narrow when the temperature of the hydraulic fluid is low, the gap further narrows due to the difference in the aforementioned coefficient of thermal expansion as the temperature of the hydraulic fluid rises, and the hydraulic fluid is more reliably restrained from leaking out.

Consequently, according to the second embodiment of the invention, the following effects are obtained as well as the aforementioned effects (1) to (6). (7) A sleeve formed of a material having a higher coefficient of thermal expansion than the bolt 14 is employed as the sleeve 73. Thus, in the normal operating temperature range of the flow rate control valve 70 in which the temperature of the hydraulic fluid is high, the gap between the sleeve 73 and the bolt 14 is kept as narrow as possible to restrain the hydraulic fluid from leaking out and suppress the deterioration in the flow rate characteristic of the flow rate control valve 70.

Next, a third embodiment of the invention as still another concrete form thereof will be described. In the third embodiment of the invention, the material used to form the sleeve 73 has a coefficient of thermal expansion equal to or close to that of the bolt 14, but is otherwise configured identically to the first embodiment. In the embodiment, the sleeve 73 is formed of the same material as the bolt 14 (e.g., a ferreous material such as iron and steel or the like). The sleeve 73 is then press-fitted into the insertion portion 18 after the movable member 13 is fastened by the bolt 14. That is, the movable member 13 is fastened to the camshaft 12 by only the bolt 14, and then the sleeve 73 is press-fitted into the bolt 14.

Thus, the sleeve 73 and the spool 80, which are in charge of the valve function, are less susceptible to the influence of the fastening torque of the bolt 14 and less likely to be distorted than in the case where the movable member 13 is fastened by the bolt 14 with the sleeve 73 press-fitted in the insertion portion 18. Although not as small as in the case where the sleeve 73 is inserted in the insertion portion 18 in a non-press-fitted state, the local dispersion of the gap between the sleeve 73 and the spool 80 is small. The change in the flow rate characteristic of the hydraulic fluid resulting from the dispersion of the gap is small.

Further, the sleeve 73 press-fitted in the insertion portion 18 is unlikely to move in either the axial or circumferential directions. Thus, according to the third embodiment of the invention, the following effects are obtained as well as the foregoing effects (1) to (6).

The sleeve 73 formed of the same material as the bolt 14 is press-fitted into the insertion portion 18 after the movable member 13 is fastened by the bolt 14. Thus, even if the bolt 14 is distorted by the fastening torque in fastening the movable member 13, the foregoing effect (1) of suppressing the change in the flow rate characteristic resulting from the gap between the sleeve 73 and the spool 80 and the operational failure in the spool 80 can be obtained.

Further, movement of the sleeve 73 in the direction along the axis L1 during the operation or the like of the flow rate control valve 70, which causes the positional relationships between the ports 22 to 26 and the through holes 74 to deviate or causes the positional relationships between the valves 82A to 82E and small-diameter portion 81 of the spool 80 and the through holes 74 to deviate, may be restrained. As a result, it is expected that the change in the flow rate characteristic resulting from deviation is suppressed.

Figure 12:
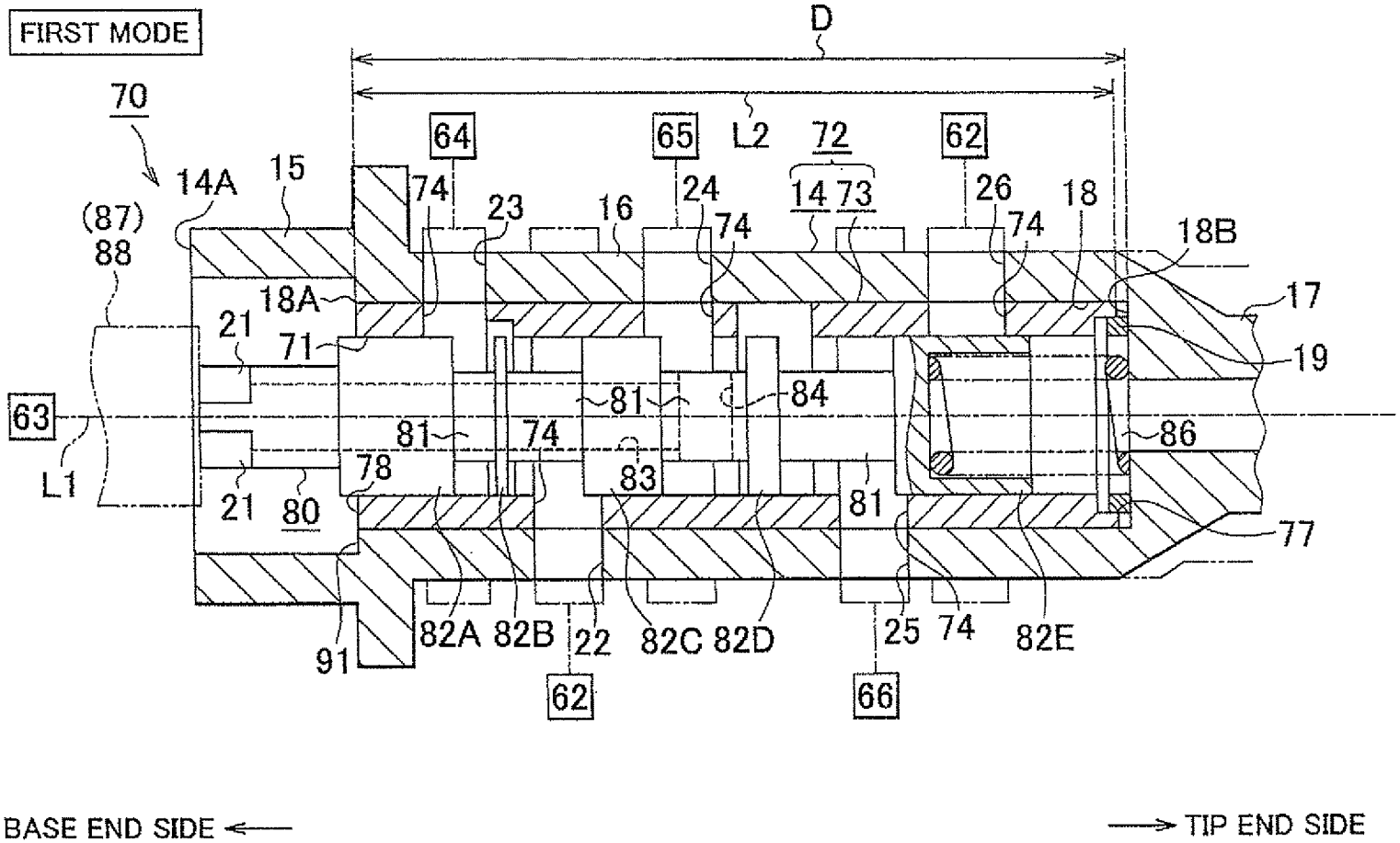
FIG. 12 shows a fourth embodiment of the invention, more specifically, a partial cross-sectional view showing the internal structure when the supply/discharge state is in the first mode.
Figure 13:
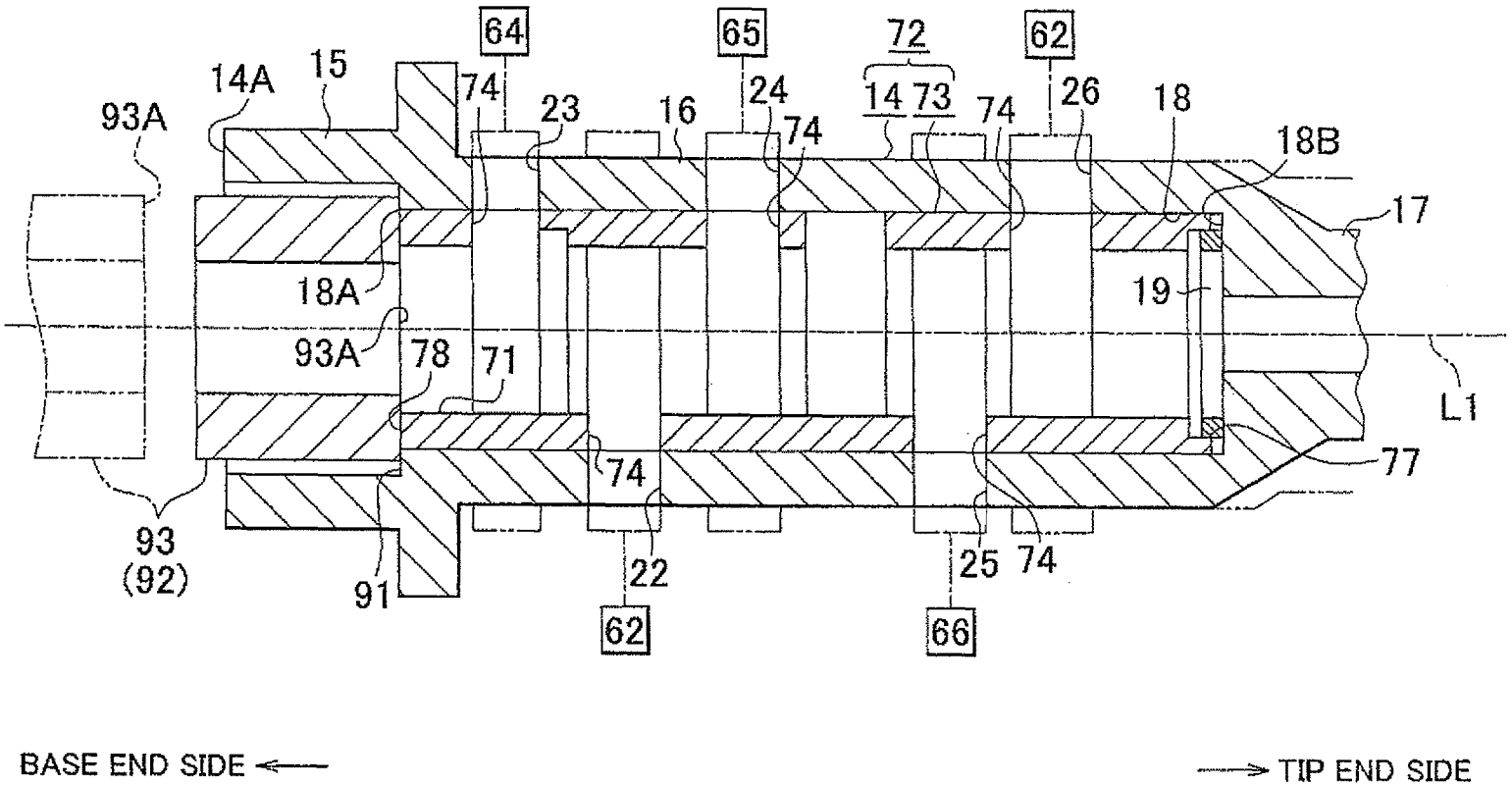
FIG. 13 is a partial cross-sectional view showing how a spool is pressed by a jig to be positioned in the flow rate control valve according to the fourth embodiment of the invention.

Next, a fourth embodiment of the invention will be described with reference to FIGS. 12 and 13.

The fourth embodiment of the invention is supposed to be applied to the flow rate control valve 70 having the sleeve 73 press-fitted in the insertion portion 18 of the bolt 14. As shown in FIG. 12, the insertion port 18A of the insertion portion 18 is formed at a position located away toward the tip end side from the base end face 14A of the bolt 14. The sleeve 73 is formed with a length L2 thereof in the direction along the axis L1 being slightly shorter than a depth D from the insertion port 18A of the insertion portion 18 to the inner bottom portion 18B thereof.

An opening end face 91 is formed around the insertion port 18A of the bolt 14. The opening end face 91 is level with a rear end face 78 of the sleeve 73 located on the rear side in an insertion direction thereof, with the ports 22 to 26 positioned corresponding through holes 74 respectively.

In the flow rate control valve 70 configured as described above, a jig 92, shown in FIG. 13, is used to insert the sleeve 73 into the insertion portion 18. The jig 92 includes a press member 93 that presses the rear end face 78 of the sleeve 73. The press member 93 has a circular cylindrical outer wall surface having a larger diameter than the outer diameter of the sleeve 73. In this embodiment, a circular tubular press member is employed as the press member 93. However, a circular columnar press member may also be employed. An annular tip end face of the press member 93 constitutes a press face 93A for pressing the sleeve 73.

When the jig 92 inserts the sleeve 73 into the insertion portion 18, the press face 93A contacts the rear end face 78 of the sleeve 73. Accordingly, the press face 93A is brought into contact with the rear end face 78 (the entire rear end face 78 is brought into contact with the press face 93A) such that an outer peripheral region of the press face 93A protrudes, along the entire circumference thereof, from the rear end face 78 of the sleeve 73.

The sleeve 73 is pressed by the press member 93 to a position where an annular region of the press face 93A which protrudes from the rear end face 78 is in contact with the opening end face 91. Accordingly, the rear end face 78 of the sleeve 73 is level with the opening end face 91, and the ports 22 to 26 are appropriately positioned with respect to the corresponding through holes 74. In this manner, the rear end face 78 of the sleeve 73 and the opening end face 91 of the bolt 14 serve as a positioning reference plane in inserting the sleeve 73 into the insertion portion 18.

Consequently, according to the fourth embodiment of the invention, the following effects are obtained in addition to the foregoing effects (1) to (6) and (8). (9) The length L2 of the sleeve 73 is set shorter than the depth D of the insertion portion 18. The opening end face 91, which is level with the rear end face of the sleeve 73, is formed around the insertion port 18A of the bolt 14 with the ports 22 to 26 coincident in position as a while with the corresponding through holes 74 respectively (FIG. 12). Thus, the sleeve 73 may be positioned so that the position of the ports 22 to 26 coincide with the corresponding through holes 74, by inserting the sleeve 73 into the insertion portion 18 until the rear end face 78 of the sleeve 73 is level with as the opening end face 91 of the bolt 14.

(10) The jig 92 may be used to insert the sleeve 73 into the insertion portion 18. The sleeve 73 is pressed to a position where the region of the press face 93A of the jig 92 for pressing the sleeve 73 which protrudes from the rear end face 78 of the sleeve 73 is in contact with the opening end face 91 of the bolt 14 (FIG. 13). Thus, the rear end face 78 of the sleeve 73 may be positioned on the same plane as the opening end face 91, and the foregoing effect (9) can be reliably obtained.

It should be noted that the invention could be embodied into the following additional embodiments thereof. At least one of the materials of the sleeve 73 and the bolt 14 may be changed to materials different from those of the foregoing second embodiment of the invention so long as the material of the sleeve 73 has a higher coefficient of thermal expansion than the material of the bolt 14.

At least one of the materials of the sleeve 73 and the bolt 14 may be changed to materials different from those indicated in the third embodiment so long as the material of the sleeve 73 has a coefficient of thermal expansion equal to or near that of the material of the bolt 14.

The size of the press member 93 may differ from that indicated in the fourth embodiment so long as that the press face 93A protrudes from the rear end face 78 of the sleeve 73.

For example, the press member 93 may have a circular cylindrical outer wall surface having a diameter smaller than the outer diameter of the sleeve 73. In this case, the sleeve 73 is pressed by the press member 93 with the axis of the press member 93 deviant from the axis L1 of the sleeve 73.

However, to uniformly press the rear end face 78 of the sleeve 73, it is desirable for the entire rear end face 78 to contact the press face 93A. In other words, it is desirable for the outer peripheral region of the press face 93A to protrude, along the entire circumference thereof, from the rear end face 78 with the axis of the press member 93 coincident with or close to the axis L1 of the sleeve 73.

The shape of the press member 93 may be changed to a shape different from that of the fourth embodiment so long as the press face 93A protrudes from the rear end face 78 of the sleeve 73. For example, the press member 93 may have an outer wall surface assuming the shape of an outer wall surface of a non-circular cylinder, for example, a rectangular cylinder.

Generally, is most desirable to have the phase of rotation of the sleeve 73 with respect to the bolt 14 adjusted to the phase in which the ports 22 to 26 strictly coincide in position with a corresponding through holes 74. However, as long as the required hydraulic fluid flow rate can be maintained, the above-described phase of the sleeve 73 may be adjusted to a phase in which most of the ports 22 to 26 coincide in position with the through holes 74 (only a part of the ports 22 to 26 does not coincide with a corresponding one of the through holes 74).

In each of the foregoing first to fourth embodiments of the invention, the through holes 74 may be substantially as long as the corresponding ports 22 to 26 respectively in the circumferential direction of the sleeve 73. The number of the through holes 74 provided in this case is equal to the number of the ports 22 to 26.

Further, if the through holes 74 are made longer than the corresponding ports 22 to 26 respectively in the circumferential direction of the sleeve 73, the number of the through holes 74 provided may be equal to or smaller than the number of the ports 22 to 26. In the latter case, the through holes 74 are formed as a notch that extends in the circumferential direction of the sleeve 73. A plurality of ports coincide in position with each through hole] 74.

In each of the foregoing first to third embodiments of the invention, a means other than the C-ring 28 may be used to stop the movement of the sleeve 73 toward the base end side. In each of the foregoing first to fourth embodiments of the invention, the number of the same type of ports formed through the tubular wall portion 16 at the same location in the direction along the axis L1 may be appropriately changed on the condition that this number be equal to or larger than 1.

A spool having therein no oil passages (the discharge hole 83 and the introduction hole 84) for the hydraulic fluid may be employed as the spool 80 according to each of the foregoing first to fourth embodiments of the invention. The shape of the annular protrusion 19 may be changed to a shape different from that of the annular protrusion 19 according to each of the foregoing first to fourth embodiments of the invention. The annular protrusion 19 may be formed in any shape as long as it has a non-circular cylindrical outer wall surface. Accordingly, the shape of the outer wall surface of the annular protrusion 19 may be changed to the shape of an outer wall surface of a polygonal cylinder such as a triangular cylinder, a rectangular cylinder, or the like, or to the shape of an outer wall surface of an elliptical cylinder. If the shape is changed, the shape of the recess 77 of the spool 80 is also changed so that the annular protrusion 19 may be fitted in the recess 77.

The flow rate control valve 70 according to the invention may also applied to variable valve timing mechanisms 11 that have no look mechanism 50 or perform the control of the lock pin 52 by a flow rate control valve different from the flow rate control valve for advancement/retardation control.

The variable mechanism may also be used to adjust other valve opening/closing characteristics of the engine valves 6, such as the valve opening timing, valve closing timing, lift amount, valve duration, valve overlap for each engine valve 6 individually, or in various combinations thereof, in addition to the aforementioned valve.

While the invention has been described in conjunction with specific example embodiments thereof, it is evident that many alternatives, modifications, and variations will be apparent to those skilled in the art. Accordingly, it should be understood that the example embodiments of the disclosure as set forth herein are intended to be illustrative, and not restrictive. Changes may be made without departing from the scope of the disclosure.

What is claimed is:

1. A flow rate control valve that is applied to an internal combustion engine equipped with a variable mechanism that operates a movable member in accordance with supply/discharge of a hydraulic fluid to make a valve opening/closing characteristic of an engine valve variable, the flow rate control valve being disposed across a plurality of oil passages through which the hydraulic fluid is supplied/discharged to/from the variable mechanism, the flow rate control valve comprising:

a housing having an accommodation chamber in communication with the respective oil passages; and a spool accommodated in the accommodation chamber movably in a reciprocating manner in a direction along an axis of the accommodation chamber, and the flow rate control valve changing a supply/discharge mode of the hydraulic fluid in accordance with a position of the spool in the direction along the axis to control the valve opening/closing characteristic, wherein the housing is equipped with a bolt for fastening the movable member and a sleeve made of a material having a higher coefficient of thermal expansion than the bolt, the sleeve having the accommodation chamber and being inserted in an insertion portion provided in the bolt;

the bolt is provided with a port through which the oil passages communicate with the insertion portion, and the sleeve is provided with a penetration portion penetrating the sleeve; and the housing is further provided with a phase adjustment portion that adjusts a phase of rotation of the sleeve with respect to the bolt to a phase in which the port coincides in position with the penetration portion by fitting an inner bottom portion of the insertion portion of the bolt to a tip end portion of the sleeve in an insertion direction, the phase adjustment portion holding the phase of rotation of the sleeve with respect to the bolt, at the phase in which the port coincides in position with the penetration portion.

2. The flow rate control valve according to claim 1, wherein the sleeve is press-fitted into the insertion portion after the movable member is fastened by the bolt.

3. The flow rate control valve according to claim 1, wherein the bolt has one end of the insertion portion in the direction along the axis as an insertion port, and the other end of the insertion portion as the inner bottom portion;

the sleeve is formed shorter than a depth from the insertion port of the insertion portion to the inner bottom portion; and the insertion port of the bolt is formed therearound with an opening end face located on a same plane as a rear end face of the sleeve, which is located on a rear side in the insertion direction, when the port is coincident in position with the penetration portion.

4. The flow rate control valve according to claim 3, wherein the rear end face of the sleeve is pressed by a jig when the sleeve is inserted into the insertion portion; and when the sleeve is pressed to a position where a region of a press face of the jig facing the sleeve, which extends beyond the rear end face is in contact with the opening end face, the rear end face of the sleeve is positioned on a same plane as the opening end face.

5. The flow rate control valve according to claim 1, wherein the variable mechanism changes a rotational phase of a camshaft relative to a crankshaft of the internal combustion engine through operation of the movable member to make valve timing of the engine valve variable as the valve opening/closing characteristic.

6. The flow rate control valve according to claim 5, wherein the housing is disposed on a same axis as the camshaft, and the movable member is disposed so as to surround the housing.

* * * * *